US009564144B2

(12) United States Patent
Nesta et al.

(10) Patent No.: US 9,564,144 B2
(45) Date of Patent: Feb. 7, 2017

(54) SYSTEM AND METHOD FOR MULTICHANNEL ON-LINE UNSUPERVISED BAYESIAN SPECTRAL FILTERING OF REAL-WORLD ACOUSTIC NOISE

(71) Applicant: CONEXANT SYSTEMS, INC., Irvine, CA (US)

(72) Inventors: Francesco Nesta, Irvine, CA (US); Trausti Thormundsson, Irvine, CA (US)

(73) Assignee: Conexant Systems, Inc., Irvine, CA (US)

( * ) Notice: Subject to any disclaimer, the term of this patent is extended or adjusted under 35 U.S.C. 154(b) by 3 days.

(21) Appl. No.: 14/809,137

(22) Filed: Jul. 24, 2015

(65) Prior Publication Data

US 2016/0029121 A1 Jan. 28, 2016

Related U.S. Application Data

(60) Provisional application No. 62/028,780, filed on Jul. 24, 2014.

(51) Int. Cl.

| | |
|---|---|
| ***H04R 3/00*** | (2006.01) |
| ***G10L 19/02*** | (2013.01) |
| ***G10L 19/26*** | (2013.01) |
| ***G10L 19/008*** | (2013.01) |

(52) U.S. Cl.

CPC ..... *G10L 19/26* (2013.01); *G10L 19/008* (2013.01); *G10L 19/02* (2013.01); *H04R 3/005* (2013.01); *H04R 2430/03* (2013.01)

(58) Field of Classification Search

CPC ..... H04R 3/00; H04R 3/002; H04R 3/005; H04R 2430/03; G10L 19/008; G10L 19/02; G10L 19/26

See application file for complete search history.

(56) References Cited

U.S. PATENT DOCUMENTS

| | | | | |
|---|---|---|---|---|
| 2003/0004715 | A1* | 1/2003 | Grover | G10L 21/0208 704/233 |
| 2013/0315403 | A1* | 11/2013 | Samuelsson | H04R 3/005 381/56 |
| 2014/0056435 | A1* | 2/2014 | Kjems | H04M 9/082 381/66 |
| 2014/0286497 | A1* | 9/2014 | Thyssen | H04R 3/005 381/66 |

(Continued)

*Primary Examiner* — Mark Fischer
(74) *Attorney, Agent, or Firm* — Haynes and Boone, LLP

(57) ABSTRACT

A system for processing audio data comprising a linear demixing system configured to receive a plurality of sub-band audio channels and to generate an audio output and a noise output. A spatial likelihood system coupled to the linear demixing system, the spatial likelihood system configured to receive the audio output and the noise output and to generate a spatial likelihood function. A sequential Gaussian mixture model system coupled to the spatial likelihood system, the sequential Gaussian mixture model system configured to generate a plurality of model parameters. A Bayesian probability estimator system configured to receive the plurality of model parameters and a speech/noise presence probability and to generate a noise power spectral density and spectral gains. A spectral filtering system configured to receive the spectral gains and to apply the spectral gains to noisy input mixtures.

20 Claims, 4 Drawing Sheets

(56) References Cited

U.S. PATENT DOCUMENTS

2015/0071461 A1* 3/2015 Thyssen ..... G10L 21/0208
381/94.1
2016/0005413 A1* 1/2016 Fellers ..... G10L 19/008
704/205

* cited by examiner

100

300

SYSTEM AND METHOD FOR MULTICHANNEL ON-LINE UNSUPERVISED BAYESIAN SPECTRAL FILTERING OF REAL-WORLD ACOUSTIC NOISE

RELATED APPLICATION(S)

The present application claims the benefit of and priority to U.S. Provisional Patent Application Ser. No. 62/028,780, filed Jul. 24, 2014, which is hereby incorporated by reference.

TECHNICAL FIELD

The present disclosure relates generally to audio processing, and more specifically to a system and method for multichannel on-line unsupersived Bayesian spectral filtering of real-world acoustic noise.

BACKGROUND OF THE INVENTION

Linear demixing or beam forming is the most common method for processing a stream of multiple audio signals with the goal of enhancing a desired acoustic source signal. Multichannel processing methods often rely on the assumptions of linearity and time invariance which are only partially able to describe the acoustic observation. As a result linear filtering is suboptimal for real-world applications and requires the signal to be compensated by non-linear time-varying statistical based post-filtering. Post-filtering approaches generally involve estimation of spectral/temporal masks (or gains) derived by the outputs of the linear filters. While masks generally improve the noise reduction ability, the masking effect could lead to severe degradation of signal quality if the demixing model uncertainty is not taken into account.

SUMMARY OF THE INVENTION

A system for processing audio data is provided that includes a linear demixing system operating on a processor and configured to receive a plurality of sub-band audio channels and to generate an audio output and a noise output. A spatial likelihood system operating on the processor and coupled to the linear demixing system, the spatial likelihood system configured to receive the audio output and the noise output and to generate a spatial likelihood function. A sequential Gaussian mixture model system operating on the processor and coupled to the spatial likelihood system, the sequential Gaussian mixture model system configured to generate a plurality of model parameters. A Bayesian probability estimator system operating on the processor and configured to receive the plurality of model parameters and a speech/noise presence probability and to generate a noise power spectral density and spectral gains. A spectral filtering system operating on the processor and configured to receive the spectral gains and to apply the spectral gains to noisy input mixtures.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
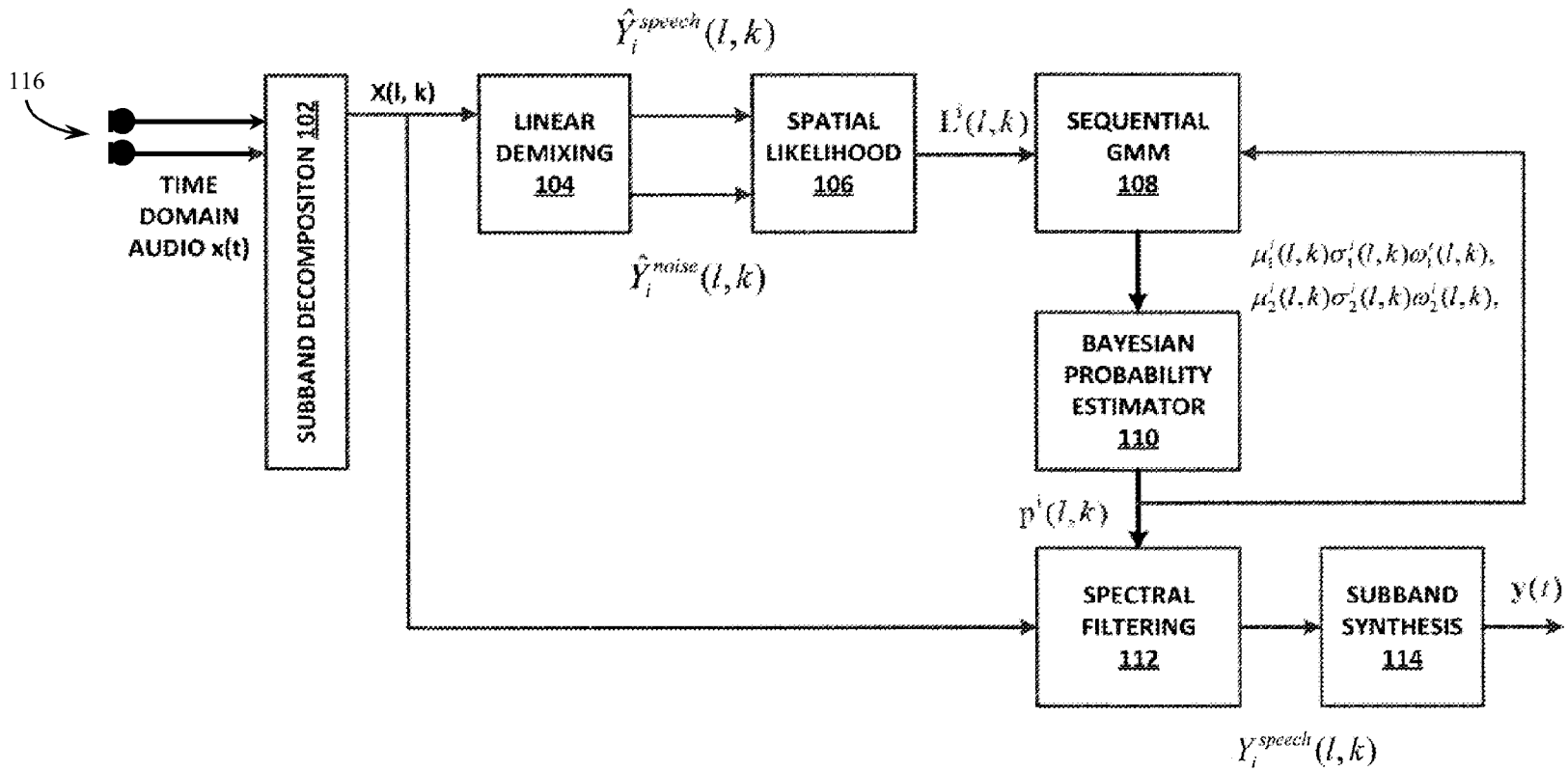
FIG. 1 is a diagram of a system for processing audio data in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Unsupervised multichannel blind spatial demixing is a power framework for separation of a given sound source of interest from the remaining noise. Unlike traditional single channel enhancement, multichannel filtering exploits spatial redundancies to discriminate between multiple sources, and can operate without making assumptions regarding the nature of the sound signal. One advantage of this process is the ability to deal with the separation of highly non-stationary signals such as speech and music. Selective Source Pickup (SSP) is an applicative example of this technology. With the SSP, noise suppression is possible even in highly reverberation conditions, because the reverberation is explicitly modeled in the optimization function. Additional information on SSP can be found in co-owned, U.S. Patent Application Public Number 2015/0117649, which is hereby incorporated by reference.

Nevertheless, there are intrinsic limitations due to the approximated system modeling. A main drawback of linear multichannel demixing is that it assumes that the mixtures are a linear combination of signals generated by a finite number of spatially localized sources, which are often referred to as coherent sources. The coherence assumption is a condition that is only partially fulfilled for the main speech source signal but not for real-world noise. Background noise is in general not localized and its multichannel spatial covariance is highly time-varying. A fast adaptive linear demixing could be employed to follow quick spatial variation of the noise, but its effectiveness would be intrinsically limited by its tracking ability and robustness. Furthermore, when multiple sources are active at the same time it may not be possible to find an exact linear demixing filter able to segregate the mixture in the individual target speech and noise components. In combination, these limitations reduce the ability of the system to suppress noise with only two channel recordings and with real-world noise sources, where multiple sources can be active at the same time.

Another limitation of multichannel linear filtering is imposed by reverberation. Even when the noise is generated by a single coherent source, it is often not possible to have an exact linear separation of the target and noise signals with spatial filters of limited length. Furthermore, small noise or target speech source movements make the estimated demixing system less accurate in describing the spatial characteristic of the mixture, which needs to be continuously tracked over time. All these modeling limitations generate at the output of the enhanced signal a consistent leakage of the residual interfering source signals. Because of these limitations, spatial filters are rarely used alone for source separation but are complemented by post-filtering methods.

The present disclosure is drawn to a method for spectral filtering based on an unsupervised learning of spectral gain distributions, which is derived from linearly-enhanced output signals. A Gaussian Mixture Model (GMM) is used to represent the distribution of the observed gains and learned sequentially with the incoming data. The GMM explicitly models the uncertainty of the observed gains. Then, a compressed version of the gains is generated from the Bayes probability of speech presence/absence, given the learned GMM parameters. These probabilities are then used to control a spectral enhancement for each channel separately.

Common post-filtering methods exploit other side information, such as spatial diffuseness and time frequency spectral sparseness of acoustic sound signals. There are a number of methods for spectral post-filtering which are used to compensate the limitation of multichannel linear demixing or beam forming. A common approach is to apply spectral masking based on instantaneous spatial likelihood. This approach assumes that there is spatial coherence in the direction of the target speech source, which underlies that the direct path is strong enough against reverberation. Nevertheless, this approach would not robustly work when using only two microphones and with a large microphone to source distance.

An alternative approach for post-filtering is to use the power of the estimated target and noise channel to estimate gains in the form of probabilities of speech absence. The residual power spectral density of the noise can be recursively estimated using this probability, and used to control a standard spectral filtering. A representative example of this approach is found in "Speech enhancement based on the general transfer function GSC and postfiltering", Sharon Gannot, Israel Cohen, IEEE Transactions on Speech and Audio Processing 12(6): 561-571 (2004). The method assumes that the generalized sidelobe canceller (GSC) beam former and a blocking matrix are able to estimate a partially enhanced target speech and noise signals. The transient power spectral density (PSD) of these two outputs is estimated by tracking the noise minima power. The ratio of the PSDs indicates whether the transient was originated by the target speech or by the noise. This data is used to control a single channel denoising method in the log spectrum domain. The main drawback of this approach is in the estimation of the a priori speech absence probability, which is heuristic and limited by the configuration parameters. Specifically, if the blocking matrix is not able to completely suppress the target speech, the resulting probability is highly biased. Furthermore, in the proposed method the blocking matrix used to estimate the noise signal is supposed to be known. This is a non-trivial assumption for far-field applications and/or when the location of the target speaker is not known a priori.

In the context of blind source separation, a spectral mask can be derived, which is then applied to the linear filtered output. This method is based on the assumption that the noise power is smaller in the target channel than in the noise channel because the spatial filters are at least able to partially attenuate the noise in the target channel. Similarly, the target signal power is much larger in the target channel instead of the noise channel. Based on the output power balance, spectral gains can be directly derived.

Spectral gains can be derived by functions of the instantaneous short-time power of target and noise channel and computed in each subband independently. In general, gains derived from the output of the spatial filters are implicitly subject to uncertainty that will eventually affect the separation performance. For example, if binary masks are used with diffuse noise in the input signal, a persistent residual in the target output would create false alarms in the derived masks. On the other hand, if there is leakage of speech in the noise output, the masks would suppress speech components in low SNR conditions, creating audible distortion. A method to explicitly model the uncertainty of the spectral masking is therefore needed, in order to improve the estimated target speech/noise signal power.

FIG. 1 is a diagram of a system 100 for post-filtering in low signal to noise ratio (SNR) conditions, in accordance with an exemplary embodiment of the present disclosure. System 100 can be implemented in hardware or a suitable combination of hardware and software, and can be one or more software systems operating on one or more processors and associated devices.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Subband decomposition 102 receives multichannel time-domain signals (e.g., audio signals received from a plurality of microphones 116) and decomposes them in a discrete time-frequency representation through subband analysis, and can use one or more algorithmic functions implemented in hardware or a suitable combination of hardware and software. The indicators "l" and "k" indicate the time frame and subband respectively. Linear demixing system 104 partially splits the original recording into target and noise signal components, such as through the application of Independent Component Analysis or in other suitable manners. The two components are provided for each input channel, such as by using the Minimal Distortion Principle (MDP), as discussed in "Minimal distortion principle for blind source separation," K. Matsuoka and S. Nakashima, Proceedings of International Symposium on ICA and Blind Signal Separation, San Diego, Calif., USA, December 2001, or in other suitable manners. The MDP provides for each channel i an estimation of the target speech in the $\hat{Y}_i^{speech}(l, k)$ and an estimation of the noise signal $\hat{Y}_i^{noise}(l, k)$. At convergence, the power of the speech output is expected to be larger than the power of the noise in speech frames. On the other hand, in the noise only frames the power of the noise output is smaller or equal to the speech output, on the average.

Spatial likelihood system 106 derives a spatial likelihood function $L^i(l, k)$ from the output signals for each subband k, frame l and channel I, and can use one or more algorithmic functions implemented in hardware or a suitable combination of hardware and software. The function is selected to produce a distribution that can be approximated with a Gaussian Mixture Model (GMM) with two main components. The component with the largest mean would represent the distribution of the likelihood for time-frequency point dominated by the target speech source, while the other component would be related to the distribution of the noise only points.

Sequential GMM system 108 applies a learning approach to update on-line the parameters of the model $\mu_1^i(l, k)$, $\mu_2^i(l, k)$, $\omega_1^i(l, k)$, $\omega_2^i(l, k)$, $\sigma_1^i(l, k)$ and $\sigma_2^i(l, k)$, and can use one or more algorithmic functions implemented in hardware or a suitable combination of hardware and software. Several constraints are introduced in order to regularize the on-line learning and avoid divergence.

For each channel, Bayesian probability estimator system 110 obtains the model parameters from sequential GMM 108, which is used to control the estimation of the noise Power Spectral Density (PSD). Bayesian probability estimator system 110 can use one or more algorithmic functions implemented in hardware or a suitable combination of hardware and software. The estimated noise PSD and the speech/noise presence probability is used to derive spectral gains which are then applied to the noisy input mixtures in spectral filtering system 112, which can use one or more algorithmic functions implemented in hardware or a suitable combination of hardware and software. Subband synthesis system 114 is adopted to reconstruct the multichannel signals back to time domain, and can use one or more algorithmic functions implemented in hardware or a suitable combination of hardware and software. A spatial likelihood $L^i(l, k)$ is derived as:

$$L^i(l, k) = \frac{E\left[\left|\hat{Y}_i^{speech}(l, k)\right|^2\right]}{E\left[\left|\hat{Y}_i^{speech}(l, k)\right|^2\right] + E\left[\left|\hat{Y}_i^{noise}(l, k)\right|^2\right]} \tag{1}$$

where the expectation E[ ] is substituted with smooth average over time. If the spatial filters were ideally able to split the noise from the speech component, equation (1) would represent the gain of a Wiener filter that could be used to enhance the input signal. However, the output signal related to the target speech $\hat{Y}_i^{speech}(l, k)$ also contains residual noise that cannot be suppressed by the spatial filter. Similarly, the output signal related to the noise contains residual of the target speech also cannot be canceled by the speech filters. The equation can be approximated as:

$$L^i(l, k) = \frac{E[|S_i(l, k) + \alpha(k)N_i(l, k)|^2]}{E[|S_i(l, k) + \alpha(k)N_i(l, k)|] + E[|N_i(l, k) + \beta(k)S_i(l, k)|^2]} \tag{2}$$

where $S_i(l, k)$ and $N_i(l, k)$ indicate the "true" target speech and noise signal component at the $i^{th}$ microphone and $\alpha(k)$ and $\beta(k)$ are coefficients smaller than 1, indicating the average amount of residual. Assuming for simplicity that the noise and the speech are uncorrelated, the equation can be rewritten as $$L^i(l, k) = \frac{E[SNR_i(l, k)] + \alpha^2(k)}{E[SNR_i(l, k)](1 + \beta^2(k)) + (1 + \alpha^2(k))} \tag{3}$$

where $SNR_i(l, k)$ is the true signal-to-noise ratio (between the target speech and total noise).

Assuming that the speech and noise signals are ideally sparse in the time-frequency representation, the likelihood $L^i(l, k)$ assumes values between 0 and 1 only if $\alpha^2(k)=0$ and $\beta^2(k)=0$. The likelihood would then represent the ideal Wiener spectral gain. However, due to the uncertainty of the spatial filters, $\alpha\mathbf{2}(k)$ and $\beta\mathbf{2}(k)$ can be small but never equal to 0. By plotting the histogram of $L^i(l, k)$ over a large number of time-frequency points, it is possible to observe that the estimated distribution is bimodal and can be approximately modeled as a GMM with two components. The component with the largest mean is expected to represent the distribution of the spatial likelihood for a source dominating the target speech channel. Then, by estimating the parameter of the GMM model, a better representation of the data can be estimated, absorbing the uncertainty of the Wiener gain in eq. 1.

The GMM follows the incremental learning approximation, such as described in "Voice activity detection based on an unsupervised learning framework," D. Ying, Y. Yan, J. Dang, and F. Soong, Audio, Speech, and Language Processing, IEEE Transactions on, vol. 19, no. 8, pp. 2624-2633, November 2011. The dependence on the channel i is removed, to simplify the notation. All the computations can be performed for each output channel independently.

The class label is defined by $c \in \{1, 0\}$, where 1 represents "target speech present" and 0 represents "target speech absent." The probability $p(c=1|L^i(l, k), \lambda(l, k)|$, where $\lambda(l, k)=[\mu_1(l, k), \sigma_1(l, k), \omega_1(l, k), \mu_2(l, k), \sigma_2(l, k), \omega_2(l, k)]$ is the parameter vector for the target speech and noise component models, estimated at the frame l. The probability of target speech presence can be computed using the Bayes formula as:

$$p(c = 1 \mid L(l, k), \lambda(l, k)) = \frac{w_1(l, k)p(L(l, k) \mid c = 1, \lambda(l, k))}{\sum_{c=1}^{2} w_c(l, k)p(L(l, k) \mid c, \lambda(l, k))} \tag{4}$$

In iterative learning, the mixture parameters are computed in the next frame as $$w_c(l + 1, k) = (1 - \eta) \cdot w_c(l, k) + \eta \cdot p(c \mid L(l + 1, k), \lambda(l, k)) \tag{5}$$

$$\mu_c(l + 1, k) = \frac{(1 - \eta) \cdot \mu_c(l, k) + \eta \cdot p(c \mid L(l + 1, k), \lambda(l, k))L(l + 1, k)}{w_c(l + 1, k)} \tag{6}$$

-continued $$\sigma_c(l+1,k) = (1-\eta)\cdot\sigma_c(l,k) + \frac{\eta\cdot p(c\mid L(l+1,k),\lambda(l,k))(L(l+1,k)-\mu_c(l+1,k))^2}{w_c(l+1,k)} \quad (7)$$

By iterating equations (4)-(7), the GMM parameters are updated on-line with the incoming data.

To avoid divergence in trivial solutions some constraints are applied. First, the component weight of speech can approach to zero if the speech is absent for a long time. To avoid this divergence we add a constraint to its value as $$w_1(l,k)=\min[\max(w_1(l,k),\epsilon),1-\epsilon] \quad (8)$$

$$w_0(l,k)=1-w_1(l,k) \quad (9)$$

where epsilon is set to a small value (e.g. 0.05). Another constraint is tight with the meaning of the estimated distributions. If the spatial filters are estimated in the right direction, i.e. by focusing on the target source and reducing the noise, when the target source dominates the noise the power at the output target channel will be larger than the power at the noise channel. It implies that the mean of the Gaussian speech component needs to be larger than the one related to the noise. The following constraint can then be imposed:

$$\mu_1(l,k)>\mu_2(l,k). \quad (10)$$

Another constraint can also be used to avoid having the variances $\sigma 1$ and $\sigma 2$ approach 0:

$$\sigma_c(l,k)=\min(\sigma_c(l,k),\epsilon_\sigma),\forall c \quad (11)$$

where $\epsilon_\sigma$ is a small value (e.g. 0.0001).

Through the probability in the general structure for the post filtering, the final spectral filtering can be carried out in different ways. For example, the noise PSD can be recursively estimated as follows.

$$\hat{\gamma}(l,k)=\gamma[1-p(c=1\mid L(l,k),\lambda(l,k))] \quad (12)$$

$$\mathrm{PSD}(l+1,k)=(1-\hat{\gamma}(l,k))\mathrm{PSD}(l,k)+\hat{\gamma}(l,k)\mid\hat{Y}_i^{speech}(l+1,k)\mid^2 \quad (13)$$

where $\gamma$ is the maximum smoothing coefficient in the recursive PSD estimation. Given the estimated noise PSD, a suitable single-channel based spectral enhancement method can be used for the filtering such as Wiener filtering with Decision Directed SNR estimation or spectral subtraction based methods, such as described in "Unified framework for single channel speech enhancement," I. Tashev, A. Lovitt, and A. Acero, IEEE Pacific Rim Conference on Communications, Computers and Signal Processing, August 2009.

Figure 2:
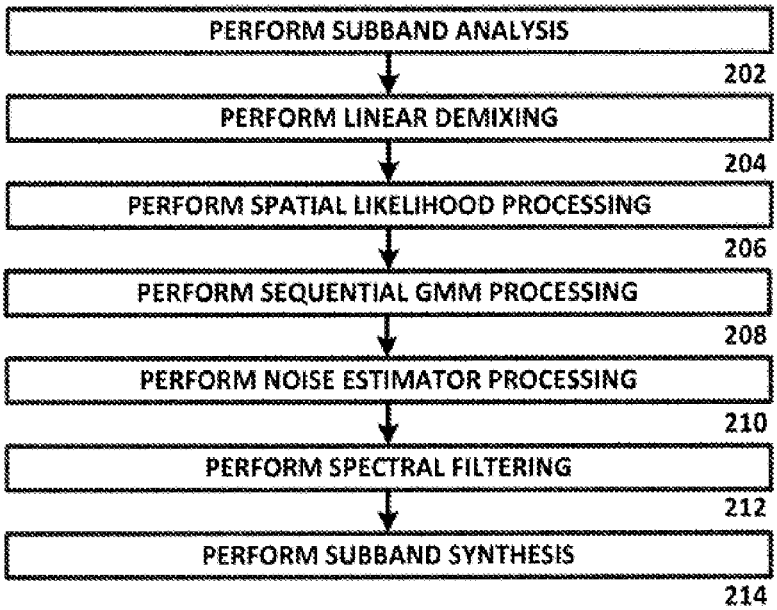
FIG. 2 is a diagram of an algorithm for multichannel on-line unsupervised Bayesian spectral filtering of real-world acoustic noise, in accordance with an exemplary embodiment of the present disclosure.

FIG. 2 is a diagram of an algorithm 200 for multichannel on-line unsupervised Bayesian spectral filtering of real-world acoustic noise, in accordance with an exemplary embodiment of the present disclosure. Algorithm 200 can be implemented in hardware or a suitable combination of hardware and software, and can be one or more software systems operating on one or more processors and associated devices.

Algorithm 200 begins at 202, where subband analysis is performed on multichannel time-domain signals, received through a plurality of audio sensors, by transforming them to K under-sampled complex-valued subband signals using a processor. The algorithm then proceeds to 204, where linear demixing is performed to partially split the original time-domain signals into target and noise components. The algorithm then proceeds to 206.

At 206, spatial likelihood processing is performed. In one exemplary embodiment, algorithms (1) through (3) or (14) through (16) can be implemented in hardware or a suitable combination of hardware and software to perform spatial likelihood processing, or other suitable processes can also or alternatively be used. The algorithm then proceeds to 208.

At 208, sequential GMM processing is performed. In one exemplary embodiment, algorithms (4) through (11) (possibly extended with (14) through (19)) can be implemented in hardware or a suitable combination of hardware and software to perform sequential GMM processing, or other suitable processes can also or alternatively be used. The algorithm then proceeds to 210.

At 210, noise estimator processing is performed. In one exemplary embodiment, algorithms (12) and (13) (where (4) can be extended with (20)) can be implemented in hardware or a suitable combination of hardware and software to perform noise estimator processing, or other suitable processes can also or alternatively be used. The algorithm then proceeds to 212.

At 212, spectral filtering is performed. The algorithm then proceeds to 214. At 214, subband synthesis is performed.

In operation, algorithm 200 allows multichannel on-line unsupervised Bayesian spectral filtering of real-world acoustic noise to be performed, such as for processing audio signals or for other suitable purposes.

Figure 3:
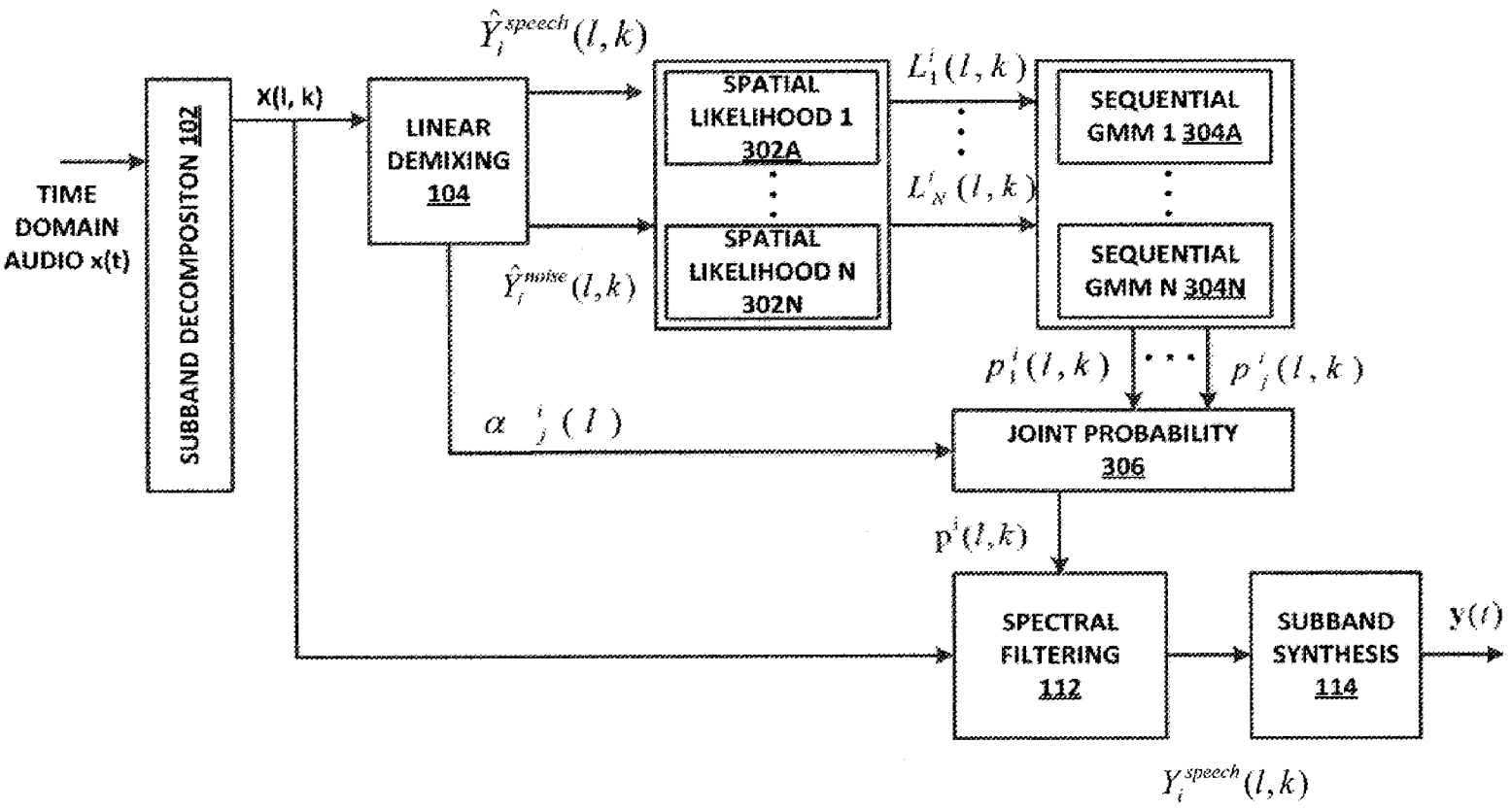
FIG. 3 is a diagram of a system for post-filtering in low signal to noise ratio (SNR) conditions, in accordance with an exemplary embodiment of the present disclosure.

FIG. 3 is a diagram of a system 300 for post-filtering in low signal to noise ratio (SNR) conditions, in accordance with an exemplary embodiment of the present disclosure. System 300 is similar to system 100, except that spatial likelihood system 106 is replaced by spatial likelihood 1 system 302A to spatial likelihood N system 302N, sequential GMM system 108 is replaced by sequential GMM 1 system 304A to sequential GMM N system 304A, and Bayesian probability estimator system 110 is replaced by joint probability estimator system 306, each of which can use one or more algorithmic functions implemented in hardware or a suitable combination of hardware and software. The algorithmic functions associated with each of these systems are described in further detail below.

To improve the speech probability estimation, multiple spatial/spectral likelihood features can be defined using independent GMMs. The GMMs can be estimated in parallel and the resulting posterior probabilities can be combined together according to different degree of confidence. For example, three basic features can be defined from the output signals for isolating different characteristic of the signals at the input and output of the spatial filters:

$$L_1^i(l,k) = \frac{E[|X_i(l,k)|^2]}{E[|X_i(l,k)|^2] + E\left[\left|\hat{Y}_i^{noise}(l,k)\right|^2\right]}, \quad (14)$$

$$L_2^i(l,k) = \frac{E\left[\left|\hat{Y}_i^{speech}(l,k)\right|^2\right]}{E\left[\left|\hat{Y}_i^{speech}(l,k)\right|^2\right] + E[|X_i(l,k)|^2]}, \quad (15)$$

$$L_3^i(l,k) = E\left[\left|\hat{Y}_i^{speech}(l,k)\right|^2\right]. \quad (16)$$

$L_1^i(l, k)$ is used to discriminate between the target speech source and the remaining noise (both diffuse and localized). The value of $L_1^i(l, k)$ is a function of the target speech parameters estimated in the linear demixing block, and is maximized when the speech dominates the noise. $L_2^i(l, k)$ is used to discriminate between the localized coherent noise from the remaining speech and diffuse noise. The value of $L_2^i(l, k)$ is a function of the noise filter parameters, and is maximized when the coherence noise is absent or is dominated by the target speech. $L_3^i(l, k)$ is used to discriminate between acoustic events having low and high spectral power, and can further be used to differentiate the background stationary noise from the speech signal components.

The statistical characteristics of each feature can be modeled with a GMM with two main components, where the component with the largest mean represents the target speech source. The (posterior) speech presence probability estimated by each feature and for each channel i can be defined as:

$$p_1^i(c=1|L_1^i(l,k),\lambda_1^i(l,k)), \tag{17}$$

$$p_2^i(c=1|L_2^i(l,k),\lambda_2^i(l,k)), \tag{18}$$

$$p_3^i(c=1|L_3^i(l,k),\lambda_3^i(l,k)), \tag{19}$$

where $\lambda_1^i(l, k)$, $\lambda_2^i(l, k)$ and $\lambda_3^i(l, k)$ are the GMM model parameters estimated for each feature. Then, a joint probability can be computed using the following algorithmic function:

$$p^i(c=1|L_j^i(l,k),\lambda_j^i(l,k),\forall j)=\min_j[\alpha_j^i(l)\times p_j^i(c=1|L_j^i(l,k),\lambda_j^i(l,k))] \tag{20}$$

where $\alpha_j^i(l)$, is a confidence function increasing to a large value (>>1) as the jth feature becomes unreliable at the frame l. As a measurement of unreliability, the function is formulated to capture the variance of the hidden variables related to each single feature. For example, $L_1^1(l, k)$ and $L_1^2(l, k)$ depends on the speech and noise filters estimated by the adaptive linear demixing. Then $\alpha_1^i(l)$, $\alpha_2^i(l)$ should be designed to capture their average temporal variance.

Figure 4:
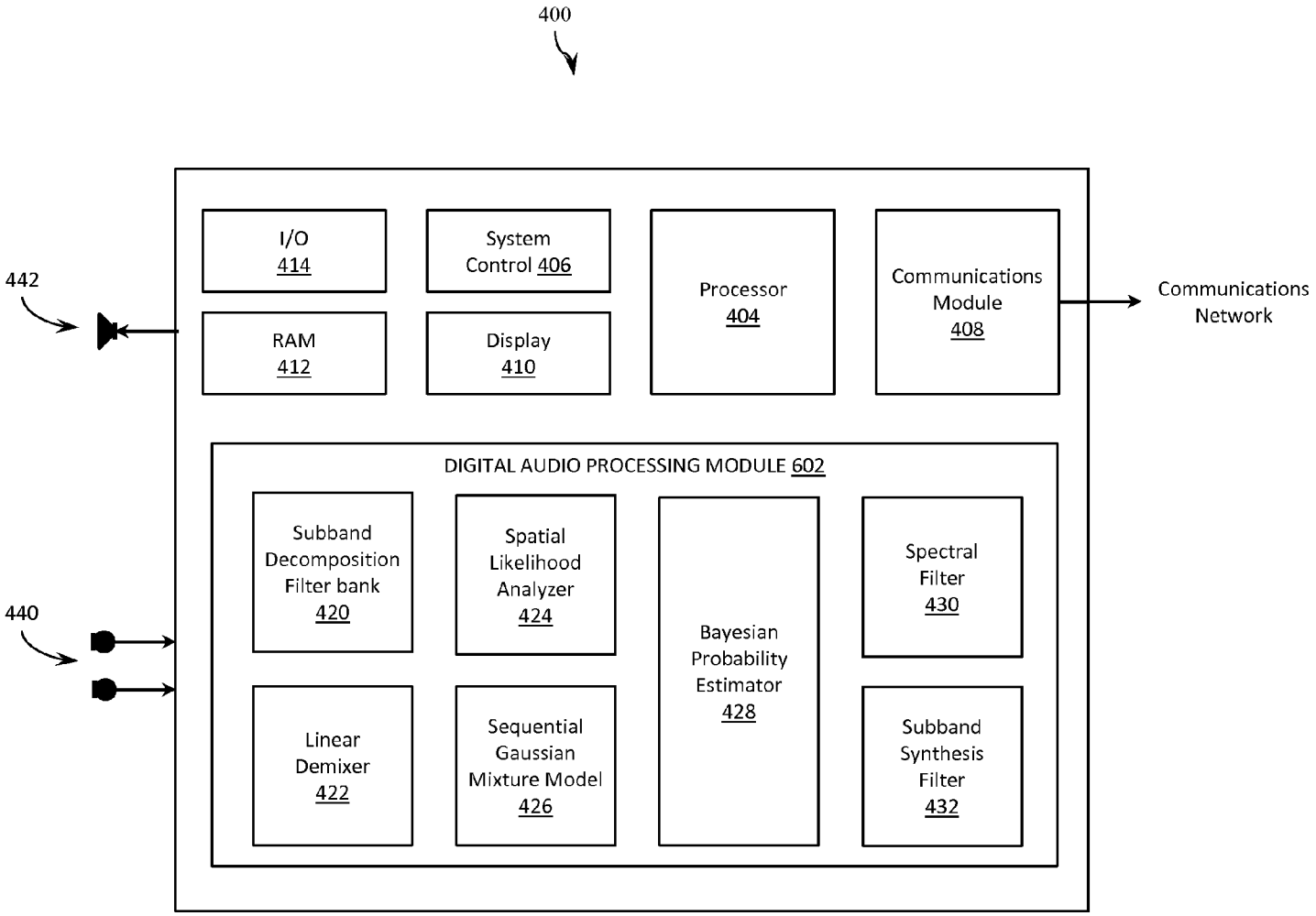
FIG. 4 is a diagram of an exemplary embodiment of a voice controlled device implementing an embodiment of the systems and method of FIGS. 1-3.

FIG. 4 is a diagram of an exemplary embodiment of a voice communications device 400 suitable for implementing the systems and methods disclosed herein. The device 600 includes multiple audio sensors, such as microphones 440 for receiving time-domain audio signals. The device 400 further includes a digital audio processing module 402 providing an embodiment of the audio processing described herein. The digital audio processing module 602 includes a subband decomposition filter bank 420, a linear demixer 422, spatial likelihood analyzer 424, sequential Gaussian mixture model 426, Bayesian probability estimator 428, spectral filter 430 and subband synthesis filter 432.

In one embodiment, the digital audio processing module 402 is implemented as a dedicated digital signal processor DSP. In an alternative embodiment, the digital audio processing module 402 comprises program memory storing program logic associated with each of the components 420 to 432, for instructing a processor 404 to execute the corresponding audio processing algorithms of the present disclosure.

The device 400 may also include a communications module 408 for transmitting processed audio signals to another communications device, system control logic 406 for instructing the processor 404 to control operation of the device 400, a random access memory 412, a visual display 410, a user input/output 414 and at least one loudspeaker 442.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for processing audio data comprising:

a linear demixing system operating on a processor and configured to receive a plurality of sub-band audio channels and to generate an audio output and a noise output;

a spatial likelihood system operating on the processor and coupled to the linear demixing system, the spatial likelihood system configured to receive the audio output and the noise output and to generate a spatial likelihood function;

a sequential Gaussian mixture model system operating on the processor and coupled to the spatial likelihood system, the sequential Gaussian mixture model system configured to generate a plurality of model parameters;

a Bayesian probability estimator system operating on the processor and configured to receive the plurality of model parameters and a speech/noise presence probability and to generate a noise power spectral density and spectral gains; and a spectral filtering system operating on the processor and configured to receive the spectral gains and to apply the spectral gains to noisy input mixtures.

2. The system of claim 1 further comprising:

a plurality of microphones generating a multichannel audio input signal corresponding to sensed audio input.

3. The system of claim 2 further comprising:

a subband decomposition filter bank configured to receive the multichannel audio input signal and decompose each channel of the multichannel audio input signal into the plurality of sub-band audio channels.

4. The system of claim 3 further comprising:

a subband synthesis filter configured to receive an output of the spectral filtering system and reconstruct a multichannel time-domain audio signal.

5. The system of claim 1 wherein the spatial likelihood function produces a distribution approximating a Gaussian Mixture Model with two main components.

6. The system of claim 5 wherein a first of the two main components having a largest mean represents a distribution of a likelihood for a time-frequency point dominated by a target speech source.

7. The system of claim 6 wherein a second of the two main components represents a distribution of noise only points.

8. A method for processing audio data comprising:

linearly demixing a plurality of sub-band audio channels to generate a multichannel audio output and a noise output;

determining a spatial likelihood of the received audio output and the noise output and generating a spatial likelihood function;

modeling a sequential Gaussian mixture from the spatial likelihood function and generating a plurality of model parameters;

estimating a Bayesian probability using the received model parameters and a speech/noise presence probability and generating a noise power spectral density and spectral gains; and spectral filtering the received spectral gains and applying the spectral gains to noisy input mixtures.

9. The method of claim 8 further comprising:

receiving a multichannel audio input signal through a plurality of microphones to generate a multichannel audio input signal corresponding to a sensed audio input.

10. The method of claim 9 further comprising:

decomposing each channel of the received multichannel audio input signal into a plurality of sub-band audio channels.

11. The method of claim 10 further comprising, after the spectral filtering:

reconstructing a multichannel time-domain audio signal.

12. The method of claim 11 wherein the spatial likelihood function produces a distribution approximating a Gaussian Mixture Model with two main components.

13. The method of claim 12 wherein a first of the two main components having a largest mean represents a distribution of a likelihood for a time-frequency point dominated by a target speech source.

14. The method of claim 13 wherein a second of the two main components represents a distribution of noise only points.

15. An audio communications system comprising:

a plurality of microphones generating a multichannel audio input signal corresponding to sensed audio input; and a digital audio processor comprising:

a subband decomposition filter bank configured to receive the multichannel audio input signal and decompose each channel of the multichannel audio input signal into a plurality of sub-band audio channels;

a linear demixing system configured to receive the plurality of sub-band audio channels and to generate an audio output and a noise output;

a spatial likelihood system coupled to the linear demixing system, the spatial likelihood system configured to receive the audio output and the noise output and to generate a spatial likelihood function;

a sequential Gaussian mixture model system coupled to the spatial likelihood system, the sequential Gaussian mixture model system configured to generate a plurality of model parameters;

a Bayesian probability estimator configured to receive the plurality of model parameters and a speech/noise presence probability and to generate a noise power spectral density and spectral gains; and a spectral filtering system operating on the processor and configured to receive the spectral gains and to apply the spectral gains to noisy input mixtures.

16. The audio communications system of claim 15 further comprising:

a communications module configured to transmit processed audio signals across a communications network.

17. The audio communications system of claim 15 wherein the digital audio processor further comprises a program memory, and wherein the subband decomposition filter bank, linear demixing system, spatial likelihood system, sequential Gaussian mixture model system, Bayesian probability estimator, and spectral filtering system are implemented as program logic stored in the program memory, the program logic being operable to instruct the digital audio processor to process the multichannel audio input signal.

18. The audio communications system of claim 15 wherein the digital audio processor further comprises a subband synthesis filter configured to receive an output of the spectral filtering system and reconstruct a multichannel time-domain audio signal.

19. The audio communications system of claim 15 wherein the spatial likelihood function produces a distribution approximating with a Gaussian Mixture Model with two main components.

20. The audio communications system of claim 19 wherein a first of the two main components having the largest mean represents a distribution of a likelihood for a time-frequency point dominated by a target speech source, and a second of the two main components represents a distribution of noise only points.

* * * * *